US011950647B2

(12) United States Patent
Small

(10) Patent No.: US 11,950,647 B2
(45) Date of Patent: Apr. 9, 2024

(54) ADJUSTABLE GARMENT FOR CHILDREN

(71) Applicant: Khamiya Small, Lithia Springs, GA (US)

(72) Inventor: Khamiya Small, Lithia Springs, GA (US)

( * ) Notice: Subject to any disclaimer, the term of this patent is extended or adjusted under 35 U.S.C. 154(b) by 0 days.

(21) Appl. No.: 17/340,801

(22) Filed: Jun. 7, 2021

(65) Prior Publication Data

US 2022/0386718 A1 Dec. 8, 2022

(51) Int. Cl.
*A41D 15/00* (2006.01)
*A41B 13/00* (2006.01)

(52) U.S. Cl.
CPC ..... *A41D 15/002* (2013.01); *A41B 13/005* (2013.01)

(58) Field of Classification Search
CPC ..... A41D 13/005; A41D 13/04; A41D 13/08; A41D 2300/22; A41D 9/08; A41D 15/005
USPC ..... 2/80
See application file for complete search history.

(56) References Cited

U.S. PATENT DOCUMENTS 1,084,065 A * 1/1914 Brinker ..... A41B 9/08 2/78.2
1,110,053 A * 9/1914 Hatch ..... A41B 9/08 2/78.2
1,190,448 A * 7/1916 Murray ..... A41B 9/08 2/78.1
1,341,317 A * 5/1920 Hanna ..... A41B 13/005 2/83
1,356,261 A * 10/1920 Butters ..... A41B 9/08 2/78.2
1,385,221 A * 7/1921 Meier ..... A41B 13/08 2/112
1,512,171 A * 10/1924 Homling ..... A41B 9/08 2/78.2
1,635,455 A * 7/1927 Belang ..... A41B 9/08 2/78.2
2,048,120 A * 7/1936 Greenbaum ..... A41D 15/002 D2/738
2,418,050 A * 3/1947 Shank ..... A41B 13/08 D2/743
2,580,024 A * 12/1951 Hoffman ..... A41B 13/04 2/70
2,666,203 A * 1/1954 Berman ..... A41B 13/08 D2/700

(Continued)

FOREIGN PATENT DOCUMENTS

GB 2588841 A * 5/2021 ..... A41B 11/14
WO WO-03103421 A1 * 12/2003 ..... A41B 13/005

*Primary Examiner* — Heather Mangine
(74) *Attorney, Agent, or Firm* — Alston & Bird LLP

(57) ABSTRACT

Various embodiments are directed to an adjustable garment and method of using the same. In various embodiments, an adjustable garment may comprise An adjustable garment comprising: a body portion comprising: one or more leg portions configured to cover at least a portion of a wearer's legs; a pair of detachable foot covers configured to cover and extend over a wearer's feet; one or more adjustable elements configured to facilitate an adjustment of a length of at least a portion of the adjustable garment in one or more length directions; wherein the adjustable garment is selectively configurable between an unexpanded configuration and an expanded configuration based at least in part on the one or more adjustable elements.

9 Claims, 10 Drawing Sheets

(56) References Cited

U.S. PATENT DOCUMENTS 2,705,326 A * 4/1955 Lahnstein ..... A41D 10/00 2/269
3,555,567 A * 1/1971 Owen ..... A41B 13/005 2/69.5
3,650,273 A * 3/1972 Schaar ..... A41B 13/04 2/402
3,665,516 A * 5/1972 Orovan ..... A41D 15/002 2/269
3,852,824 A 12/1974 Grey
4,573,218 A * 3/1986 Saggs ..... A41D 15/002 2/93
5,367,709 A * 11/1994 Teasley ..... A41B 13/08 2/69
5,708,977 A * 1/1998 Morkunas ..... A41D 15/002 2/269
6,058,508 A * 5/2000 Brown Honeysuckle ..... A41B 13/005 2/69
6,223,352 B1 * 5/2001 Watlington ..... A41D 15/002 2/83
6,654,968 B2 * 12/2003 Braun ..... A41D 27/10 2/269
7,318,240 B1 * 1/2008 Rendone ..... A41B 9/08 450/12
7,966,669 B1 * 6/2011 Siepmann ..... A41D 15/002 2/123
7,971,272 B2 7/2011 Bailey et al.
8,225,422 B1 * 7/2012 McSparron ..... A41B 13/005 2/69.5
9,089,174 B1 * 7/2015 Michaelis ..... A41D 13/0015
9,179,712 B2 11/2015 Jaggernauth
2006/0107437 A1 * 5/2006 Griesbach, III ... A41D 13/1209 2/114
2007/0266472 A1 * 11/2007 DuFaux ..... A41D 15/002 2/80
2009/0019616 A1 * 1/2009 Smith ..... A41D 13/129 2/269
2010/0299802 A1 * 12/2010 Bailey ..... A41F 19/005 2/269
2012/0297518 A1 * 11/2012 Aiken ..... A41B 13/005 2/69
2014/0317828 A1 * 10/2014 Holsinger ..... A41B 13/08 2/80
2015/0059049 A1 * 3/2015 Jaggernauth ..... A41B 13/08 2/80
2015/0121603 A1 * 5/2015 Lang ..... A41D 11/00 2/80
2016/0050980 A1 * 2/2016 Cartozian ..... A41B 1/06 2/70
2016/0255886 A1 * 9/2016 Arzu ..... A47G 9/06
2018/0071173 A1 * 3/2018 Hunter ..... A41D 27/10
2018/0235290 A1 * 8/2018 Pfanner ..... A41D 15/002
2018/0255853 A1 * 9/2018 Spathas ..... B65D 33/00
2019/0104771 A1 * 4/2019 Wollschlaeger ..... A41B 13/005
2020/0060355 A1 * 2/2020 Nguyen ..... A41B 13/08
2020/0170316 A1 * 6/2020 Barski ..... A41D 1/06
2021/0137179 A1 * 5/2021 Zaki ..... A41D 11/00

* cited by examiner

ADJUSTABLE GARMENT FOR CHILDREN

FIELD OF THE INVENTION

Various embodiments described herein relate generally to wearable garments for children. In particular, various embodiments are directed to wearable garments with adjustable components configured to facilitate the selective transitioning between various garment sizes in order to accommodate the growth of a child over time.

BACKGROUND

Commercial applications may use adjustable garments for children as wearable articles of clothing for people prone to changes in size over time, such as, for example, children. In particular, an adjustable garment for children may be used to facilitate repeated use of a single wearable garment by a growing child in a comfortable, well-fitting configuration that spans various increasing clothing sizes. Through applied effort, ingenuity, and innovation, Applicant has solved problems relating to wearable garments for children by developing solutions embodied in the present disclosure, which are described in detail below.

BRIEF SUMMARY

Various embodiments are directed to an adjustable garment and method of using the same. In various embodiments, an adjustable garment may comprise An adjustable garment comprising: a body portion comprising: one or more leg portions configured to cover at least a portion of a wearer's legs; a pair of detachable foot covers configured to cover and extend over a wearer's feet; one or more adjustable elements configured to facilitate an adjustment of a length of at least a portion of the adjustable garment in one or more length directions; wherein the adjustable garment is selectively configurable between an unexpanded configuration and an expanded configuration based at least in part on the one or more adjustable elements.

In various embodiments, the adjustable garment may further comprise a rear opening arranged about a back side; and a rear cover panel configured to extend over the rear opening. In various embodiments the rear cover panel may comprise a material that is different from the body portion. In certain embodiments, the rear cover panel may comprise an elastic material. In various embodiments, the one or more adjustable elements may comprise a plurality of fastener elements, at least one of the plurality of fastener elements comprising a convertible fastener element configured for selective coupling to a first fastener element in order to configure the adjustable garment in a first garment configuration, and a second fastener element in order to configure the adjustable garment in a second garment configuration, wherein the first fastener element and the second fastener element are fixedly attached to a distinct portions of the adjustable garment. In certain embodiments, the first fastener element may be fixedly attached to a rear cover panel and the second fastener element is fixedly attached to the one or more leg portions, such that the first garment configuration is defined by a rear cover panel configuration and the second garment configuration is defined by an expandable leg portion configuration, wherein the one or more adjustable elements comprises an expandable leg portion defined at least in part by the convertible fastener element.

In various embodiments, the more one or more adjustable elements may comprise an expandable body portion configured to facilitate adjustment of a body portion length in an at least substantially vertical direction, at least a portion of the expandable body portion being removably coupled to the body portion. In certain embodiments, the at least a portion of the expandable body portion may be removably coupled to an interior surface of the body portion. In certain embodiments, the expandable body portion may comprise a plurality of incremental adjustment fastener elements extending in a vertical direction and configured for selective coupling to the body portion, wherein each of the plurality of incremental adjustment fastener elements corresponds to a respective incremental expansion length such that the adjustable garment is further selectively configurable between a plurality of partially expanded configurations based at least in part on the plurality of incremental adjustment fastener elements. In certain embodiments, the expandable body portion may comprise an elastic band. In various embodiments, the elastic band may comprise a first end and a second end, and an elastic band fastener element positioned at the first end. In certain embodiments, the body portion may include a plurality of interior incremental fastener elements disposed about an interior surface of the body portion; and wherein the elastic band fastener element is configured for selectively coupling to at least a portion of the interior plurality of incremental fastener elements. Further, in certain embodiments, the expandable body portion may comprise a plurality of elastic bands.

In various embodiments, the one or more adjustable elements may comprise an elastic garment portion formed from an elastic material. In certain embodiments, the elastic garment portion may be configured to facilitate a transition of the adjustable garment between an unexpanded configuration and an expanded configuration based on one or more pulling forces acting on the elastic garment portion caused by the wearer's body. In certain embodiments, the one or more adjustable elements may comprise one or more of the adjustable elements comprises an expandable portion including one or more fastener elements and a material expansion portion defined at least in part by an expansion length, wherein the adjustable garment is configured such that the garment length is increased by an additional length corresponding to the expansion length when the expandable portion is configured in an expanded configuration.

In various embodiments, the one or more leg portions may comprise a plurality of adjustable elements. In various embodiments, the adjustable garment may further comprise a pair of arm portions coupled to and extending outward from the body portion. In various embodiments, each of the pair of arm portions comprises a plurality of adjustable elements. In various embodiments, each of the detachable feet covers may be selectively coupled to and removable from a respective adjustable element positioned adjacent the one or more leg portions such that the respective adjustable elements extend between the one or more leg portions and the pair of detachable foot covers.

BRIEF DESCRIPTION OF THE DRAWINGS

Reference will now be made to the accompanying drawings, which are not necessarily drawn to scale, and wherein.

DETAILED DESCRIPTION

Figure 1:
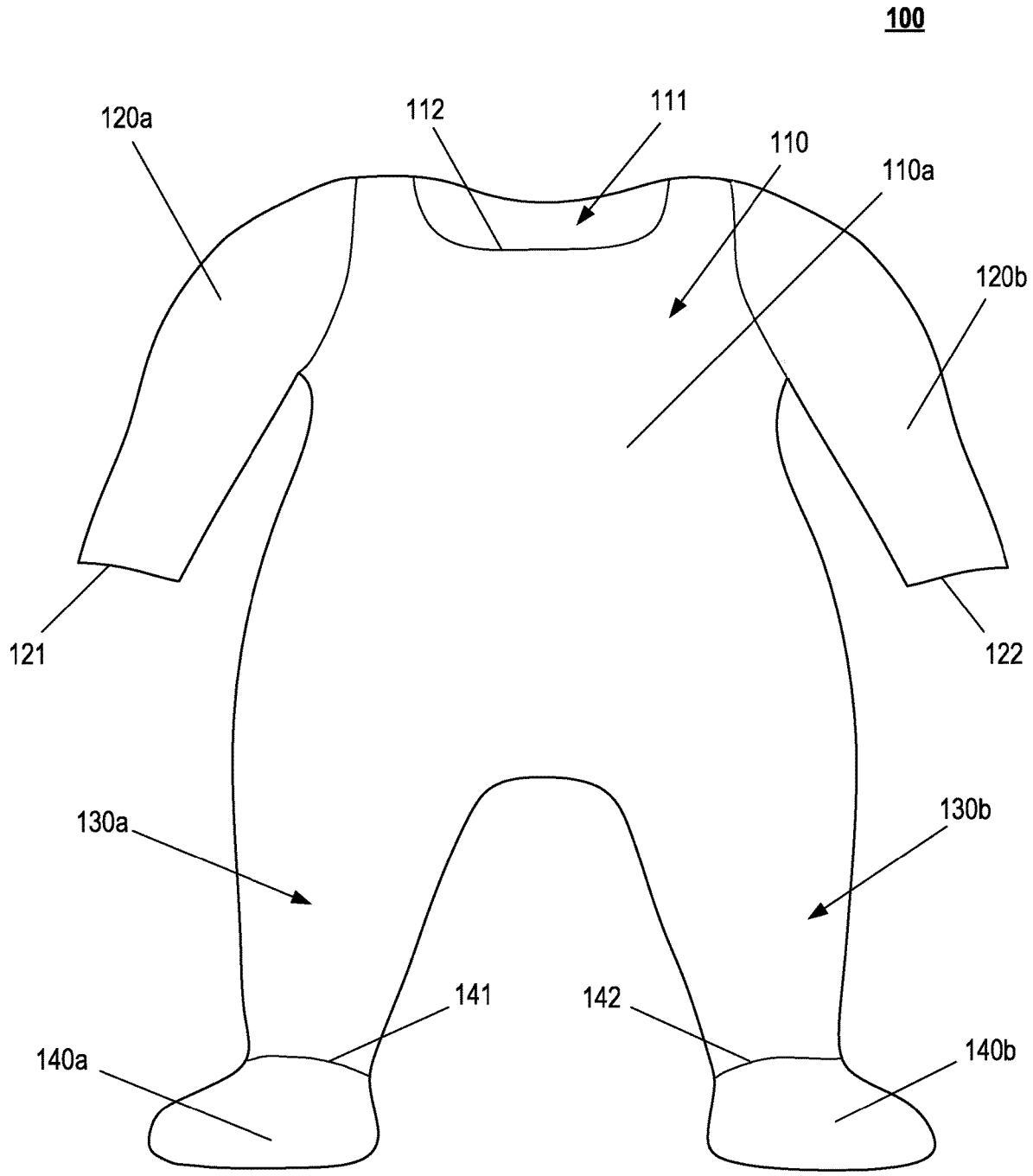
FIG. 1 illustrates a front view of an exemplary garment according to an embodiment as described herein.

The present disclosure more fully describes various embodiments with reference to the accompanying drawings. It should be understood that some, but not all embodiments are shown and described herein. Indeed, the embodiments may take many different forms, and accordingly this disclosure should not be construed as limited to the embodiments set forth herein. Rather, these embodiments are provided so that this disclosure will satisfy applicable legal requirements. Like numbers refer to like elements throughout.

It should be understood at the outset that although illustrative implementations of one or more aspects are illustrated below, the disclosed assemblies, systems, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents. While values for dimensions of various elements are disclosed, the drawings may not be to scale.

The words "example," or "exemplary," when used herein, are intended to mean "serving as an example, instance, or illustration." Any implementation described herein as an "example" or "exemplary embodiment" is not necessarily preferred or advantageous over other implementations.

As used herein, the vertical direction (i.e., the +/−Z-direction as depicted) refers to the upward/downward direction of the adjustable garment. The longitudinal direction (i.e., the +/−X-direction as depicted) refers to the forward/rearward direction of the adjustable garment and is transverse to the vertical direction. The lateral direction (i.e., the +/−Y-direction as depicted) refers to the cross-wise direction of the adjustable garment and is transverse to the vertical direction and the longitudinal direction.

Adjustable garments according to the present disclosure generally include a garment comprising a singular piece that is configured to provide coverage over a wearer's torso, chest, back, legs, and arms. For example, in embodiments, an adjustable garment may comprise a singular garment defined at least in part by i) a body portion including a front body portion and a back body portion configured to provide coverage over a wearer's torso, chest, and back; ii) further, by two leg portions configured to provide coverage over a wearer's legs; and iii) and, further, by two arm portions configured to provide coverage over at least a portion of a wearer's arms. In embodiments, the adjustable garments include one or more adjustable elements configured to facilitate the dimensional flexibility of the garment in one or more directions, such as, for example, in a vertical (i.e. length) direction, in order to accommodate the growth of a wearer in a length direction by minimizing the rigidity of at least a portion of the adjustable garment in the length direction. In some embodiments, the adjustable garments include a pair of foot covers configured to cover and extend over a wearer's feet may be selectively coupled to and removable from a leg portion of the adjustable garment. In some embodiments, the adjustable garment is configured to flexibly provide coverage over the wearer's upper body and lower body. Further, in various embodiments, the adjustable garments may also be configured to extend over a wearer's feet and/or arms.

Referring initially to FIG. 1, a front view of an adjustable garment 100 according to an exemplary embodiment is schematically depicted. The adjustable garment 100 is configured to be worn by a wearer, such as, for example, a child, and generally includes a body portion 110, including a front body portion 110*a* configured to provide coverage over a wearer's torso and chest. As illustrated, the body portion 110 may comprise a neck orifice 111 arranged about an upper end of a body portion 110 and configured to receive at least a portion of a wearer's head and/or neck therethrough. For example, the neck orifice 111 may be defined at least in part by a collar 112 that extends around an outer perimeter of the neck orifice 111. In various embodiments, at least a portion of the body portion 110 may be formed from one or more suitable materials such as, by way of non-limiting example, nylon, spandex, elastane, polyester, cotton, and/or the like, and may include a blend or combination thereof.

In various embodiments, the adjustable garment 100 further includes a pair of leg portions 130*a*, 130*b*, each comprising an at least substantially tubular garment portion extending from a lower end of the body portion 110 and being configured to cover at least a portion of a respective one of a wearer's legs. In various embodiments, the leg portions 130*a*, 130*b* may be removably coupled to the body portion 110 or, alternatively, may define a portion of a singular piece used to make at least the body portion 110 and the leg portions 130*a*, 130*b*, such that the leg portions 130*a*, 130*b* are fixedly attached (e.g., seamlessly, along a seam) to the lower end of the body portion 110. For example, each leg portion 130*a*, 130*b* may extend from an upper leg portion end disposed at least substantially adjacent a lower end of the body portion 110 along a length of the leg portion 130*a*, 130*b* in a length direction (e.g., at least substantially in the z-direction) to a respective lower leg portion end 141, 142. In various embodiments, at least a portion of the leg portions 130*a*, 130*b* may be formed from one or more suitable materials such as, by way of non-limiting example, cotton, nylon, spandex, elastane, polyester, and/or the like, and may include a blend or combination thereof. For example, in various embodiments, at least a portion of the leg portions 130*a*, 130*b* may be formed from a suitable material for providing an expandable leg portions, as described herein, including, but not limited to an elastic and/or a woven rubber material such as, for example, nylon, spandex, elastane, polyester, or the like, and may include a blend or combination thereof. In various embodiments, at least a portion of the leg portions 130*a*, 130*b* may comprise a material that is either at least substantially the same or, alternatively, at least substantially different than the one or more materials included in the body portion 110 of the adjustable garment 100.

In various embodiments, the adjustable garment 100 may further comprise includes a pair of arm portions 120*a*, 120*b*, each comprising an at least substantially tubular garment portion extending from an upper end of the body portion 110 and being configured to cover at least a portion of a respective one of a wearer's arms. In various embodiments, the arm portions 120*a*, 120*b* may be removably coupled to the body portion 110 or, alternatively, may define a portion of a singular piece used to make at least the body portion 110 and the arm portions 120*a*, 120*b*, such that the arm portions 120*a*, 120*b* are fixedly attached (e.g., seamlessly, along a seam) to the upper end of the body portion 110. For example, each arm portion 120*a*, 120*b* may extend from an upper arm portion end disposed at least substantially adjacent an upper end of the body portion 110 along a length of the arm portion 120*a*, 120*b* to a respective lower arm portion end 121, 122. For example, in various embodiments, each of the arm portions 120*a*, 120*b* may embody a sleeve configured to receive at least a portion of a wearer's arm, such that the respective lower arm portion ends 121, 122 of the arm portions 120*a*, 120*b* may embody a cuff of the respective sleeve. In various embodiments, at least a portion of the arm portions 120*a*, 120*b* may be formed from one or more suitable materials such as, by way of non-limiting example, cotton, nylon, spandex, elastane, polyester, and/or the like, and may include a blend or combination thereof. For example, in various embodiments, at least a portion of the arm portions 120*a*, 120*b* may be formed from a suitable material for providing an expandable arm portions, as described herein, including, but not limited to an elastic and/or a woven rubber material such as, for example, nylon, spandex, elastane, polyester, or the like, and may include a blend or combination thereof. In various embodiments, at least a portion of the arm portions 120*a*, 120*b* may comprise a material that is either at least substantially the same or, alternatively, at least substantially different than the one or more materials included in the body portion 110 and/or the leg portions 130*a*, 130*b*, of the adjustable garment 100.

In embodiments, the adjustable garment 100 may include a pair of foot covers 140*a*, 140*b* that extend from one of the leg portions 130*a*, 130*b* at a respective lower leg portion end 141, 142 thereof and are configured to cover at least a portion of a respective one of a wearer's feet. In various embodiments, the foot covers 140*a*, 140*b* may be removably attached to the leg portions 130*a*, 130*b* or, alternatively, may define a portion of a singular piece used to make the leg portions 130*a*, 130*b*, such that the foot covers 140*a*, 140*b* are fixedly attached (e.g., seamlessly, along a seam) to the lower leg portion ends 141, 142 of the leg portions 130*a*, 130*b*. For example, in various embodiments wherein the foot covers 140*a*, 140*b* are removably attached (e.g., so as to define a detachable configuration) relative to the leg portion 130*a*, 130*b*, the lower leg portion ends 141, 142 may define a foot cover interface configured to receive at least a portion of a respective foot cover 140*a*, 140*b* such that the respective foot cover 140*a*, 140*b* may be removable secured thereto. In such an exemplary circumstance, the foot covers 140*a*, 140*b* may be selectively coupled to the respective leg portion 130*a*, 130*b* by one or more mechanical fastening means, such as, for example, hook and loop fasteners, snaps, buttons, zippers, magnets, and/or the like, including any mechanism that may be used to facilitate the temporary and/or semi-permanent attachment and detachment of one piece of clothing from another other. In embodiments in which the foot covers 140*a*, 140*b* are selectively coupled to and/or removable from the rest of the adjustable garment 100, the foot covers 140*a*, 140*b* may be removed as necessary, without requiring the wearer to remove and/or replace the entire adjustable garment 100. In various embodiments, at least a portion of the foot covers 140*a*, 140*b* may be formed from one or more suitable materials such as, by way of non-limiting example, cotton, nylon, spandex, elastane, polyester, and/or the like, and may include a blend or combination thereof. For example, in various embodiments, may be formed from a suitable material for providing an expandable foot portions, as described herein, including, but not limited to an elastic and/or a woven rubber material such as, for example, nylon, spandex, elastane, polyester, or the like, and may include a blend or combination thereof. In various embodiments, at least a portion of the arm portions 120*a*, 120*b* may comprise a material that is either at least substantially the same or, alternatively, at least substantially different than the one or more materials included in the body portion 110 and/or the leg portions 130*a*, 130*b* of the adjustable garment 100.

Figure 2:
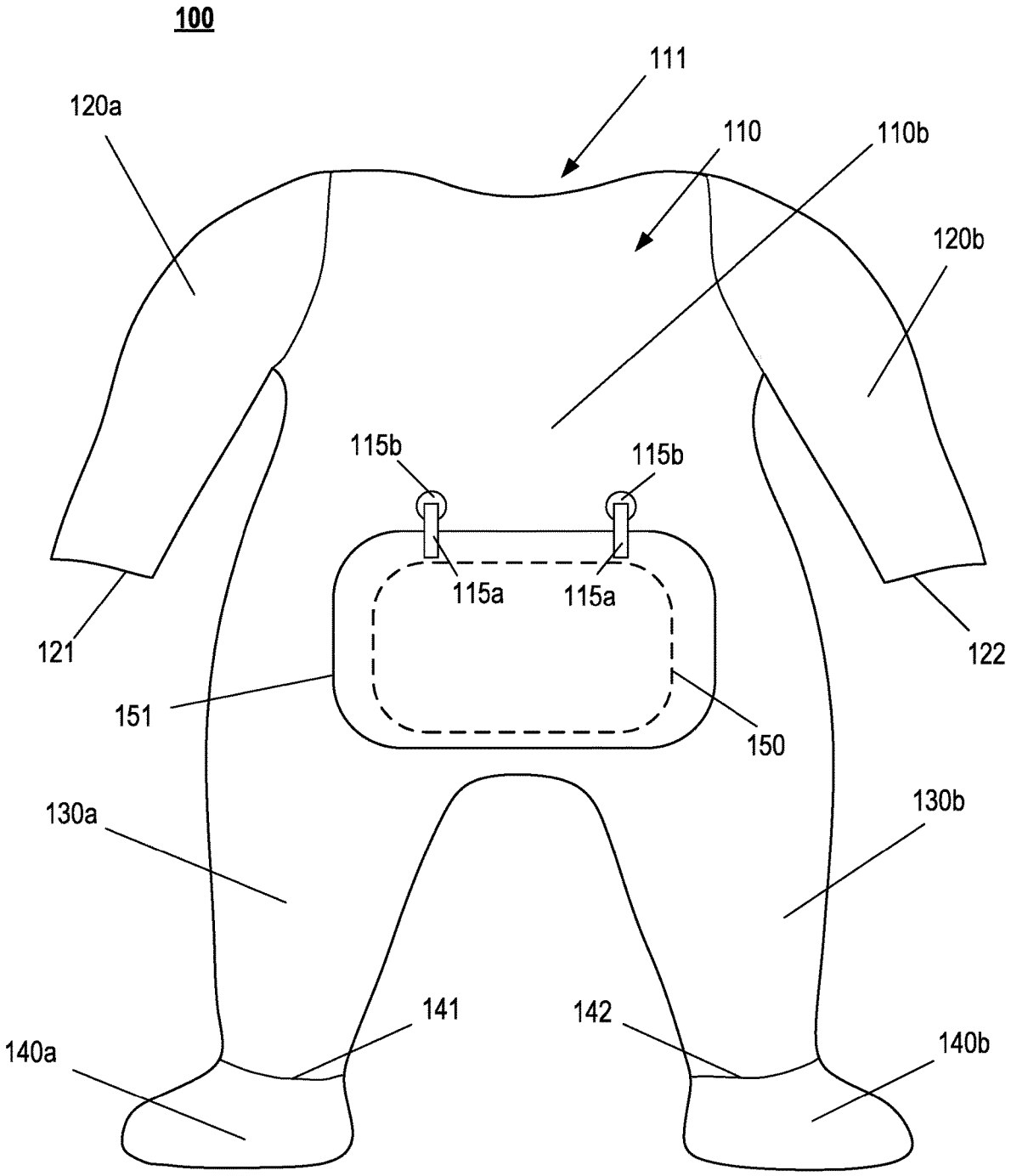
FIG. 2 illustrates a back view of an exemplary garment according to an embodiment as described herein.

Referring to FIG. 2, a rear view of an adjustable garment 100 according to an exemplary embodiment is schematically depicted. The exemplary adjustable garment 100 includes a body portion 110, including a back body portion 110*b* configured to provide coverage over a rear portion of a wearer's body (e.g., a wearer's back). In various embodiments, at least a portion of the back body portion 110*b* may comprise a material that is either at least substantially the same or, alternatively, at least substantially different than the one or more materials included in the front body portion 110*a* and/or the leg portions 130*a*, 130*b* of the adjustable garment 100. As illustrated, in various embodiments, the back body portion 110*b* may define a portion of a singular piece used to make at least the body portion 110 and/or the leg portions 130*a*, 130*b*, such that the back body portion 110*b* is fixedly attached (e.g., seamlessly, along a seam) to one or more of the front body portion 110*a*, the leg portions 130*a*, 130*b*, and the arm portions 120*a*, 120*b* of the adjustable garment 100.

In various embodiments, as illustrated in FIG. 2, the adjustable garment 100 may comprise a rear opening 150 arranged about a back side of the adjustable garment 100. For example, in various embodiments, an adjustable garment 100 may comprise a rear opening 150 embodying an orifice defined within at least a portion of one or more of a rear body portion 110*b* and the leg portions 130*a*, 130*b*. For example, an exemplary adjustable garment 100 may be configured such that the rear opening 150 is disposed at least substantially adjacent a rear portion of a wearer's body, such that the rear portion of the wearer's body adjacent the rear opening 150 may be accessed without requiring that the entire adjustable garment 100 be removed. As a non-limiting example, the rear opening 150 may be disposed at least substantially adjacent a wearer's buttocks and/or an undergarment such as, for example, a diaper, configured to provide coverage over the wearer's buttocks, such that the diaper being worn by the wearer may be accessed, removed, and/or replaced as necessary, without requiring that the wearer (i.e. a wearer's caretaker) take off the entire adjustable garment 100.

Further, in various embodiments, the adjustable garment 100 may comprise a rear cover panel 151 configured to extend over the rear opening 150 and provide coverage over the rear portion of the wearer's body and/or the wearer's undergarment positioned adjacent the rear opening 150 (e.g. the wearer's buttocks and/or a diaper being used by the wearer). In various embodiments, at least a portion of the rear cover panel 151 may be selectively coupled to a corresponding portion of the body portion 110 and/or the leg portions 140*a*, 140*b* of the adjustable garment 100 by one or more mechanical fastening means, such as, for example, hook and loop fasteners, snaps, buttons, zippers, magnets, and/or the like, including any mechanism that may be used to facilitate the temporary and/or semi-permanent attachment and detachment of at least a portion of the rear cover panel 151 from the adjustable garment 100. As described herein, the rear cover panel 151 may be selectably configurable between a closed configuration wherein the rear opening is at least substantially inaccessible, and an at least partially open configuration, wherein at least a portion of the rear cover panel 151 is detached from the adjustable garment 100 such that the rear opening may be accessed.

In various embodiments, the rear cover panel 151 may be defined at least in part by a surface area that is at least substantially larger than a surface area of the rear opening 150. For example, in various embodiments, the rear cover panel 151 may be configured to cover at least substantially all of the rear opening 150 when configured in a closed configuration, as described herein. In various embodiments, the rear cover panel 151 may comprise a rear cover panel shape defined at least in part by an outer perimeter thereof, which define any geometrical shape, such as, for example, circular, rectangular, polygonal, and/or the like, configured to at least substantially surround an outer perimeter of the rear opening 150. As a non-limiting example, the rear cover panel 151 may comprise a rear cover panel shape that corresponds at least in part to the configuration of one or more portions of the adjustable garment 100 (e.g., one or more leg portions 140*a*, 140*b*), as described in further detail herein. In various embodiments, at least a portion of the rear cover panel 151 may comprise a material that is either at least substantially the same or, alternatively, at least substantially different than the one or more materials included in the body portion 110 and/or the leg portions 130*a*, 130*b* of the adjustable garment 100. Further, in various embodiments, the rear cover panel 151 may be defined at least in part by a material thickness that is either at least substantially the same or at least substantially different than a material thickness of the body portion 110 and/or the leg portions 130*a*, 130*b*.

For example, the rear cover panel 151 of the adjustable garment 100 may be configurable between the closed configuration and the at least partially open configuration based at least in part on the configuration of one or more fastener elements configured to facilitate the selective coupling of at least a portion of the rear cover panel 151 to a corresponding portion of the adjustable garment 100. As a non-limiting example, FIG. 2 illustrates an exemplary embodiment wherein the adjustable garment 100 comprises one or more first fastening elements 115*a* secured to an exterior surface of the rear cover panel 151, each of which is configured to engage a corresponding second fastening element 115*b* secured to an exterior surface of a portion of the adjustable garment 100 positioned adjacent at least substantially adjacent the rear opening 150 (e.g., a portion of the back body portion 110*b* and/or the leg portions 104*a*, 140*b*). As described herein, the one or more first fastening elements 115*a* secured to the rear cover panel 151 may be configured to engage the one or more second fastening element 115*b* secured to the body portion 110 and/or the leg portions 140*a*, 140*b* so as to secure the at least a portion of the rear cover panel 151 adjacent the one or more first fastening elements 115*a* relative to the fixed position of the one or more second fastening element 115*b*. In such an exemplary circumstance, the one or more first fastening elements 115*a* secured to the rear cover panel 151 may be configured to engage the corresponding one or more second fastening element 115*b* so as to selectably configure the rear cover panel 151 in an at least partially closed configuration. Similarly, the one or more first fastening elements 115*a* secured to the rear cover panel 151 may be configured to disengage and/or detach from the corresponding one or more second fastening element 115*b*, so as to selectably configure the rear cover panel 151 in an at least partially open configuration.

In various embodiments, an exemplary adjustable garment 100 may comprise one or more adjustable elements configured to facilitate the dimensional flexibility of the garment in one or more directions, such as, for example, in a vertical (i.e. length) direction, in order to accommodate the growth of a wearer in a length direction by minimizing the rigidity of at least a portion of the adjustable garment in the length direction. In various embodiments, the one or more adjustable elements of an exemplary adjustable garment may comprise one or more expandable portions configured to expand in a length direction so as to increase the length of at least a portion of an adjustable garment 100. For example, in various embodiments, the one or more adjustable elements may be configured to increase a length of the body portion 110, one or more leg portions 130*a*, 130*b*, one or more arm portions 120*a*, 120*b*, and/or the like, or any combination thereof, so as to increase the length of the adjustable garment and thus, expand the capacity of the adjustable garment to comfortably accommodate a growth of a wearer's body in the length direction.

In various embodiments, an exemplary adjustable garment 100 may comprise one or more expandable portions defined by a portion of an exemplary adjustable garment 100 that is formed from an expandable (e.g., stretchable) material, such as, for example, nylon, spandex, elastane, polyester, and/or the like, or any combination thereof, configured to facilitate a transition between an unexpanded configuration and an expanded configuration by stretching in a length direction to increase the length of the adjustable garment 100. For example, in an exemplary circumstance wherein a portion of a wearer's body has a first length that is greater than a second length of a corresponding portion of an adjustable garment 100 in an unexpanded configuration, an exemplary adjustable element comprising an expandable portion defined by an elastic material may be configured receive a force applied thereto by the wearer's body (e.g., directly and/or indirectly) in the length direction and, in response, stretch in the length direction so as to adjust a length dimension of the adjustable garment 100 by increasing the length of the expandable portion in order to comfortably accommodate the corresponding portion of the wearer's body. As described, the stretching of the expandable portion in the length direction may define a transition of the expandable portion from an unexpanded configuration to an expanded configuration. In such an exemplary circumstance, the magnitude of the increase in the length of the adjustable garment 100 defined by the transition of the expandable portion from an unexpanded configuration to an at least partially expanded configuration may be defined at least in part by a difference in the first length of the portion of the wearer's body and the second length of the corresponding portion of the adjustable garment 100 in an unexpanded configuration.

Further, in various embodiments, an expandable portion of an exemplary adjustable garment 100 may comprise a material extension portion having an extension length that may be selectably transitioned between an unexpanded configuration and an expanded configuration based at least in part on an attachment and/or detachment of one or more fastening elements adjacent thereto. For example, in various embodiments, a material extension portion may be defined by an extension length that extends between a first end and a second end, each end being fixedly secured to a respective adjacent portion of the adjustable garment 100. In such an exemplary circumstance, the adjustable garment 100 may comprise a pair of corresponding fastening elements positioned, respectively, adjacent the opposite ends of the material extension portion such that the two corresponding fastening elements may be selectably attached to one another in order to configure the expandable portion in an unexpanded configuration. In such an exemplary unexpanded configuration, the first and second opposite ends of the material extension portion are disposed at substantially the same position along the length of the adjustable garment 100 (e.g., via the selectably attached pair of corresponding fastening elements), such that the extension length of the material extension portion does not make up a portion of the garment length. For example, the material extension portion in an unexpanded configuration may embody an excess material that may be folded and/or otherwise arranged relative to an outer and/or inner surface of the adjustable garment 100 so as not to interfere with the wearer's use of the adjustable garment 100. In such an exemplary circumstance, the exemplary expandable portion of the adjustable garment 100 may be selectively reconfigured from an unexpanded configuration to an expanded configuration by manipulating the pair of corresponding fastening elements arranged adjacent opposite ends of the material extension portion, such as, for example, by decoupling the corresponding fastening elements, so as to unfurl and/or expand the material extension portion in order to extend the length of at least a portion of the adjustable garment 100 by a length corresponding to the extension length of the material extension portion.

In various embodiments, the one or more expandable portions may comprise a material that is either at least substantially the same or, alternatively, at least substantially different than the one or more materials included in the body portion 110, the leg portions 130*a*, 130*b*, and/or the arm portions 140*a*, 140*b* of the adjustable garment 100. Further, in various embodiments, the one or more expandable portions may be defined at least in part by a material thickness that is either at least substantially the same or at least substantially different than a material thickness of the body portion 110, the leg portions 130*a*, 130*b*, and/or the arm portions 140*a*, 140*b*.

Figure 3:
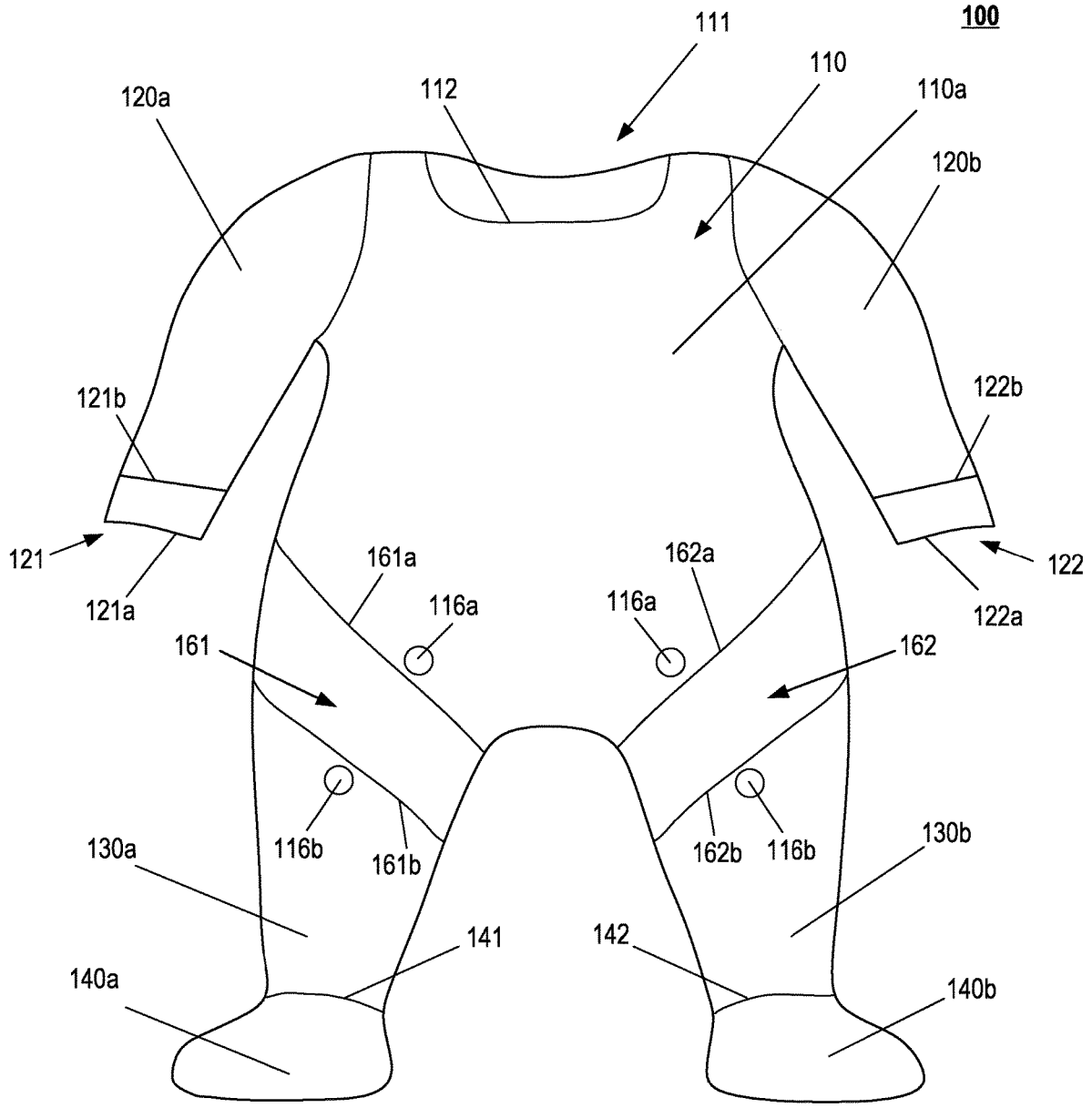
FIG. 3 illustrates a front view of an exemplary garment according to an embodiment described herein.
Figure 4:
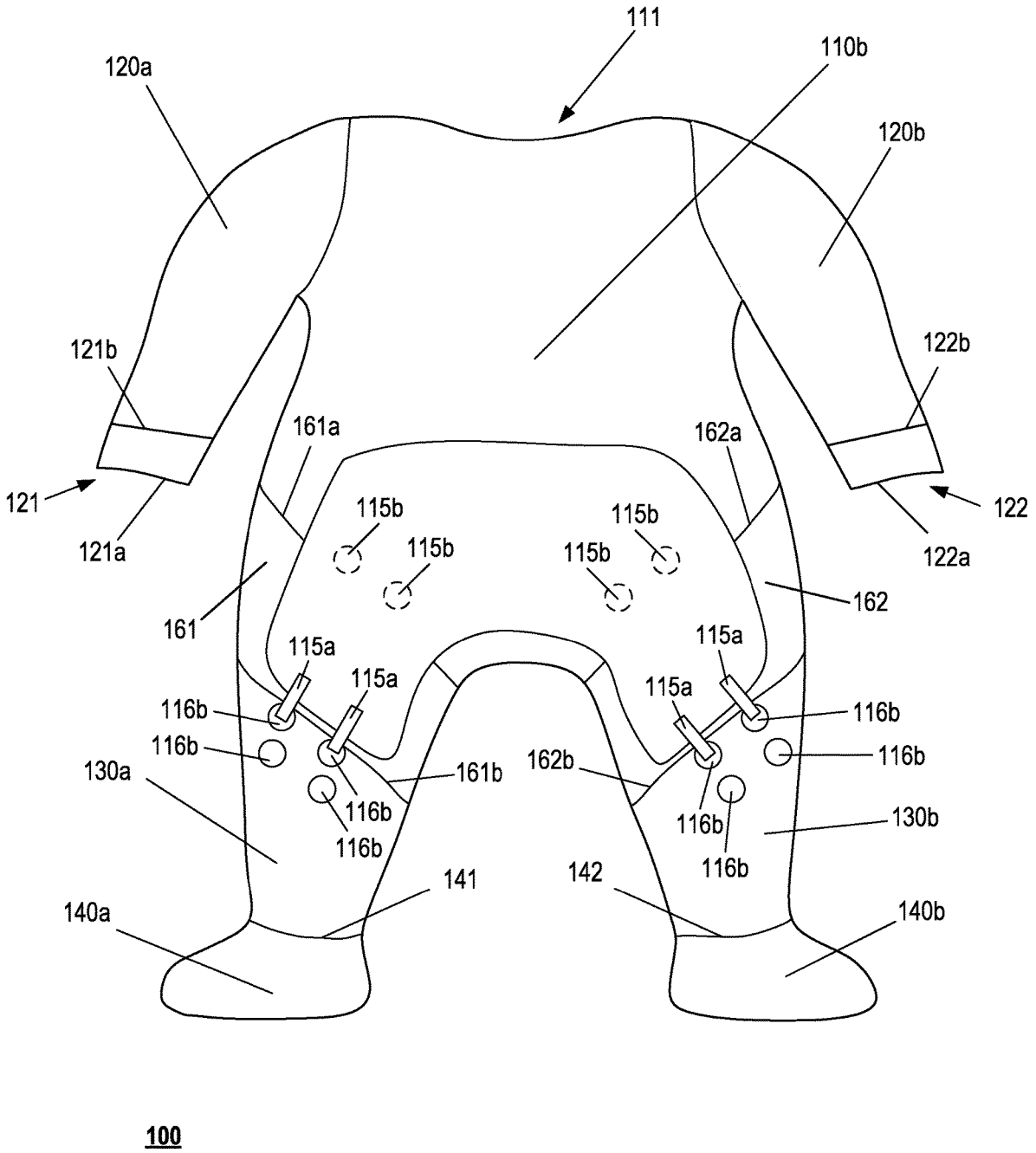
FIG. 4 illustrates a back view of an exemplary garment according to an embodiment described herein.

As illustrated in FIGS. 3 and 4, in various embodiments, an exemplary adjustable garment 100 may comprise a plurality of adjustable elements defined at least in part by one or more expandable portions. For example, an exemplary adjustable garment 100 may comprise one or more leg portions 130*a*, 130*b* defined at least in part by an adjustable element comprising an expandable leg portion. As illustrated, a non-limiting example embodiment of an adjustable garment 100 may include a plurality of expandable leg portions, including a first expandable leg portion 161 that extends at least substantially between an upper leg portion end of the first leg portion 130*a* and a lower end of the body portion 110, and a second expandable leg portion 162 that extends at least substantially between an upper leg portion end of the second leg portion 130*b* and the lower end of the body portion 110. As illustrated, a first expandable leg portion 161 may comprise a length of material extending in a length direction (e.g., at least substantially in the z-direction) between a first end 161*a* and a second end 161*b*, each end being fixedly secured to a respective adjacent portion of the adjustable garment 100. For example, the first end 161*a* may define an upper end of the first expandable leg portion 161 and may be fixedly secured at least substantially adjacent a portion of a lower end of the body portion 110. Further, the second end 161*b* may define a lower end of the first expandable leg portion 161 and may be fixedly secured at least substantially adjacent a portion of an upper end of the first leg portion 130*a*.

Similarly, a second expandable leg portion 162 may comprise a length of material defining at least a portion of the second leg portion 130*b* and extending in a length direction (e.g., at least substantially in the z-direction) between a first end 162*a* and a second end 162*b*. As described, one or more of the first and second ends 162*a*, 162*b* may be fixedly secured to a respective adjacent portion of the adjustable garment 100. By way of further example, the first end 162*a* may define an upper end of the second expandable leg portion 162 and may be fixedly secured at least substantially adjacent a portion of a lower end of the body portion 110. Further, the second end 162*b* may define a lower end of the second expandable leg portion 162 and may be fixedly secured at least substantially adjacent a portion of an upper end of the second leg portion 130*b*.

In various embodiments, the first and second expandable leg portions 161, 162 may each comprise an adjustable element defined at least in part by an expandable portion. Accordingly, in various embodiments, as described herein, one or both of the first and second expandable leg portions 161, 162 may comprise a material extension portion configured to be selectably configurable between an unexpanded configuration and an expanded configuration based at least in part on an attachment and/or detachment of one or more fastening elements positioned at least substantially adjacent thereto. For example, as illustrated, an exemplary adjustable garment 100 may comprise one or more pairs of corresponding fastening elements 116*a*, 116*b* positioned at least substantially adjacent a respective one of the expandable leg portions 161, 162.

As a non-limiting illustrative example described in reference to the illustrated first expandable leg portion, 161, a pair of corresponding fastener elements arranged adjacent the first expandable leg portion 161 may comprise a first fastening element 116*a* arranged at least substantially adjacent a first end 161*a* of the first expandable leg portion 161, and a second fastening element 116*b* arranged at least substantially adjacent a second end 161*b* of the first expandable leg portion 161, such that the corresponding fastening elements 116*a*, 116*b* are positioned adjacent opposite ends of the extension length of the first expandable leg portion 161. Further continuing the non-limiting illustrative configuration described above, the two corresponding fastening elements 116*a*, 116*b* may be selectably attached to one another in order to selectively configure the adjustable garment 100 such that the first expandable leg portion 161 is in an unexpanded configuration. As described herein, wherein the corresponding fastening elements 116*a*, 116*b* are selectively coupled to one another at substantially the same position along the length of the adjustable garment 100, the first end 161*a* and the second end 161*b* are similarly arranged at substantially the same position along the length of the adjustable garment 100, such that the extension length of the first expandable leg portion 161 does not define a portion of the garment length of the adjustable garment 100. Further, in such an exemplary circumstance, the first expandable leg portion 161 may be selectively reconfigured from an unexpanded configuration to an expanded configuration by manipulating the pair of corresponding fastening elements 116*a*, 116*b* arranged adjacent the first and second ends 161*a*, 161*b* thereof. For example, the first fastening element 116*a* may be selectively decoupled from the corresponding second fastening element 116*b*, so as to unfurl and/or expand the first expandable leg portion 161 in order to extend the length of at least a portion of the adjustable garment 100 by an expansion length that corresponds to the extension length of the first expandable leg portion 161. In various embodiments, an at least substantially similar configuration and/or an at least substantially different configuration may exist with respect to the second expandable leg portion 162.

As further illustrated in FIGS. 3 and 4, the plurality of adjustable elements defined within an exemplary adjustable garment 100 may comprise a plurality of expandable arm portions, each defining a portion of a respective arm portion extending along a length of the respective arm portion. For example, the plurality of expandable arm portions may include a first expandable arm portion 121 and a second expandable arm portion 122 positioned within a first arm portion 120*a* and a second arm portion 120*b*, respectively. In various embodiments, a first expandable arm portion 121 may comprise a length of material within the first arm portion 120*a* extending between a first end 121*b* and a second end 121*a* in a length direction (e.g., at least substantially in the z-direction). Further, a second expandable arm portion 122 may comprise a distinct length of material within the second arm portion 120*b* that extends between a first end 122*b* and a second end 122*a* in a length direction. As illustrated, in various embodiments, a first end 121*b*, 122*b* of each of the expandable arm portions 121, 122 may be fixedly secured to an adjacent portion of the respective arm portion 120*a*, 120*b*, such that the first and second expandable arm portions 121, 122 may define lower ends of the first and second arm portions 120*a*, 120*b*, respectively. For example, in various embodiments, as illustrated, one or more of the expandable arm portions 121, 122 may comprise an expandable (e.g., stretchable) material configured to enable a transition between an unexpanded configuration and an expanded configuration caused by one or more pulling forces acting on the expandable arm portion 121, 122 and resulting in an expansion (e.g., a stretching) of the expandable arm portion 121, 122 in a length direction. In such an exemplary configuration, the stretching of the elastic material that makes up the expandable arm portion 121, 122 may result in an increase in a length of at least a portion of an exemplary adjustable garment, such as, for example, a length of an arm portion 120*a*, 120*b*.

As illustrated in FIG. 4, the adjustable garment 100 may comprise one or more fastener elements that embody a convertible fastener element configured to be selectably couplable to a plurality of fastener elements corresponding, respectively, to a plurality of distinct garment portions and/or elements of an exemplary adjustable garment 100. For example, in various embodiments, an exemplary convertible fastener element may be configured such that the adjustable garment 100 may define a first garment configuration when the convertible fastener element is selectably coupled to a first corresponding fastener element, and a second garment configuration when the convertible fastener element is selectably coupled to a second corresponding fastener element, wherein the first garment configuration and the second garment configuration are at least substantially different from one another.

By way of non-limiting example, as illustrated in FIG. 4, the exemplary adjustable garment 100 comprises a plurality of fastening elements, including a plurality of convertible fastener elements 116*b* configured to be selectably couplable to a plurality of fastener elements corresponding, respectively, to a plurality of distinct garment portions and/or elements of an exemplary adjustable garment 100. For example, in various embodiments, a convertible fastener element 116*b* may be configured to be selectably couplable to at least one or more rear cover panel fastening elements 115*a* secured to an exterior surface of the rear cover panel 151, and to one or more fastening elements 115*b* fixedly secured to a leg portion 130*a*, 130*b* adjacent an exemplary expandable leg portion 161, 162. In such an exemplary circumstance, a convertible fastener element 116*b* may be configured to be selectably couplable to a rear cover panel fastening element 115*a* secured to the rear cover panel 151 such that the adjustable garment 100 is configured in a first garment configuration. Further, the convertible fastener element 116*b* may be configured to be selectably couplable to a fastening element 115*b* positioned within a first leg portion 130*a* adjacent a first expandable leg portion 161 such that the adjustable garment 100 is configured in a second garment configuration defined at least in part by the first expandable leg portion 161 being in an unexpanded configuration.

By way of further non-limiting example, the exemplary adjustable garment 100 illustrated in FIG. 4 may comprise one or more fastening elements 115*b*, as described herein, that may embody a convertible fastener element. For example, in various embodiments, a convertible fastener element 115*b* may be configured to be selectably couplable to at least one or more rear cover panel fastening elements 115*a* secured to an exterior surface of the rear cover panel 151, and to one or more fastening elements 116*b* fixedly secured to a leg portion 130*a*, 130*b* adjacent an exemplary expandable leg portion 161, 162. Further, in such an exemplary circumstance, an exemplary adjustable garment 100 may be configured such that one or more rear cover panel fastening elements 115*a*, as described herein, may be selectably couplable to both a first expandable leg portion fastening element 115*b* and a second expandable leg portion fastening element 116*b*, disposed, respectively, on opposite ends of an expandable leg portion 161, 162, as measured in a length direction. In such an exemplary circumstance, the rear cover panel 151 (e.g., the one or more rear cover panel fastening elements 115*a*) may be configured to facilitate the adjustability of the exemplary adjustable garment 100 by being selectively couplable to each of a series of corresponding expandable leg portion fastener elements (e.g., one or more first expandable leg portion fastening elements 115*b*, one or more second expandable leg portion fastening elements 116*b*) arranged at incrementally increasing distances away—as measured in the length direction—from the at least substantially fixed portion of the rear cover panel 151 arranged adjacent the rear opening 150.

In such an exemplary configuration, the rear cover panel 151 may embody an adjustable element of the adjustable garment 100 that may be selectively configurable between an unexpanded configuration and an expanded configuration, including one or more partially expanded configurations defined based at least in part by the positioning of the series of expandable leg portion fastener elements 115*b*, 116*b* at incrementally increasing distances away from the rear cover panel 151. For example, the rear cover panel 151 may be arranged in an unexpanded configuration in an exemplary circumstance wherein the rear cover panel fastener elements 115*a* are attached to a first expandable leg portion fastening element 115*b* that is disposed nearest the at least substantially fixed portion of the rear cover panel 151. By contrast, the rear cover panel 151 may be arranged in an expanded configuration in an exemplary circumstance wherein the rear cover panel fastener elements 115*a* are attached to a second expandable leg portion fastening element 116*b* that is disposed furthest away from the at least substantially fixed portion of the rear cover panel 151. In such an exemplary circumstance, as the rear cover panel 151 is selectively configured at various incremental configurations from an unexpanded configuration to an expanded configuration, the rear cover portion 151 may generate an incrementally increasing pulling force on one or more adjacent portions of the adjustable garment 100 such that the overall garment length of the adjustable garment 100 may incrementally decrease. For example, in various embodiments, as the rear cover panel 151 is selectably adjusted so as to be coupled to incrementally distanced fastener elements arranged further away from the rear cover panel 151 (e.g., a fixed portion thereof), a tension and/or a pulling force may be generated such that such a selective adjustment may result in a decrease in the garment length of at least a portion of the adjustable garment 100. Further, by contrast, as the rear cover panel 151 is selectively configured at various incremental configurations from an expanded configuration to an unexpanded configuration, the rear cover portion 151 may generate an incrementally decreasing pulling force on the one or more adjacent portions of the adjustable garment 100, such that the overall garment length of the adjustable garment 100 may incrementally increase.

Figure 5:
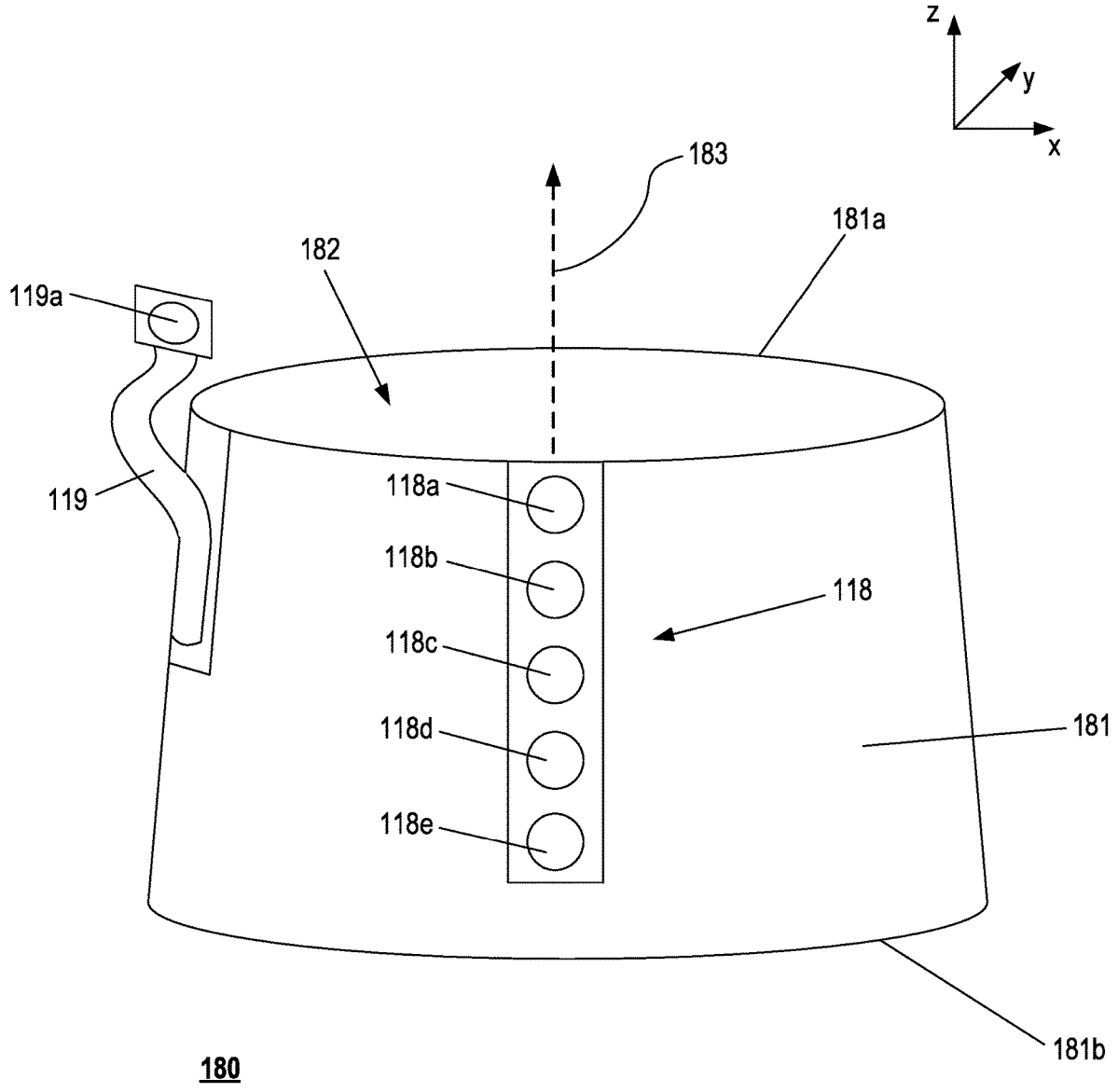
FIG. 5 illustrates a perspective view of an exemplary garment according to an embodiment described herein.

Referring to FIG. 5, a perspective view of an adjustable garment 100 according to an exemplary embodiment is schematically depicted. In particular, FIG. 5 illustrates an exemplary adjustable element comprising an expandable body portion 180, according to various embodiments. As illustrated, in various embodiments, an expandable body portion 180 may comprise an at least partially tubular expandable body panel 181 configured to extend in a length direction (e.g., at least substantially in the z-direction) along a central axis 183, so as to define at least a portion of a body portion 110 of an adjustable garment 100 configured to receive at least a portion of a wearer's body (e.g., chest, torso, back, and/or the like) therethrough. For example, the expandable body portion 180 may comprise a garment panel defined at least in part by an expandable body panel 181 that extends from an upper expandable body panel end 181*a* to a lower expandable body panel end 181*b*. The expandable body panel 181 may define an interior portion 182 configured to receive at least a portion of a wearer's body therein, such as, for example, a wearer's chest, torso, back, and/or the like, such that the expandable body portion 180 is configured to cover the at least a portion of a wearer's body disposed therein. As described in further detail with respect to FIG. 6, in various embodiments, an exemplary expandable body portion 180 may be configured such that one or both of an upper expandable body panel end 181*a* and a lower expandable body panel end 181*b* may be fixedly secured to a respective adjacent portion of the adjustable garment 100 (e.g., at respective portions along an interior surface of body portion 110).

In various embodiments, at least a portion of the expandable body portion 180, such as, for example, an expandable body panel 181, may comprise a material that is either at least substantially the same or, alternatively, at least substantially different than the one or more materials included in the body portion 110, the leg portions 130*a*, 130*b*, and/or the arm portions 140*a*, 140*b* of the adjustable garment 100, as described herein. Further, in various embodiments, the expandable body panel 181 may be defined at least in part by a material thickness that is either at least substantially the same or at least substantially different than a material thickness of the body portion 110, the leg portions 130*a*, 130*b*, and/or the arm portions 140*a*, 140*b*.

In various embodiments, an expandable body portion 180 may comprise a plurality of fastener elements configured to facilitate the adjustment of an adjustable garment 100 between an unexpanded configuration and an expanded configuration, including one or more partially expanded configurations defined at least in part by one or more intermediate expansion lengths, as described herein. For example, as illustrated, in various embodiments, an expandable body portion 180 may include a plurality of incremental adjustment fastener elements 118 comprising a plurality of fastener elements 118*a*, 118*b*, 118*c*, 118*d*, 118*e* at least partially secured to the an expandable body panel 181 and configured to be selectively coupled to one or more corresponding fastener elements fixedly secured to the body portion 110 (e.g., to an interior of the body portion 110), as described herein, in order to facilitate adjustment of the expandable body portion 180 between an unexpanded configuration and an at least partially expanded configuration. As illustrated, in various embodiments, an exemplary expandable body portion 180 may one or more fastener elements embodied as an elastic band 119 at least partially secured to the expandable body panel 181 of the expandable body portion 180. For example, an exemplary elastic band 119 may be fixedly secured to the expandable body panel 181 at a first end and may comprise a second end defined at least in part by a fastener element 119*a*. As illustrated, in various embodiments, the second end of the elastic band 119, including fastener element 119*a*, may be configured to extend away from the expandable body panel 181 in a length direction (e.g., at least substantially in the z-direction) and, further, to engage a corresponding fastener element fixedly secured to an at least substantially adjacent portion of the body portion 110 (e.g., to a fastener element fixedly disposed about an interior of the body portion 110), as described herein. In such an exemplary configuration, fastener element 119*a* may be selectably coupled to a corresponding fastener element fixedly secured at adjacent portion of the body portion 110 in order to facilitate an adjustable (i.e. a stretchable) configuration of the expandable body portion 180. For example, the selective and/or removable coupling of the elastic band 119 to the body portion 110 (e.g., via a fixed body portion fastener element coupled thereto) may enable the expandable body portion 180 to transition between an unexpanded configuration and an expanded configuration caused by one or more pulling forces acting on the expandable body portion 180 (e.g., via the elastic band 119) and resulting in an expansion (e.g., a stretching, a relative displacement, and/or the like) of the expandable body panel 181 in a length direction relative to at least part of the body portion 110.

Figure 6:
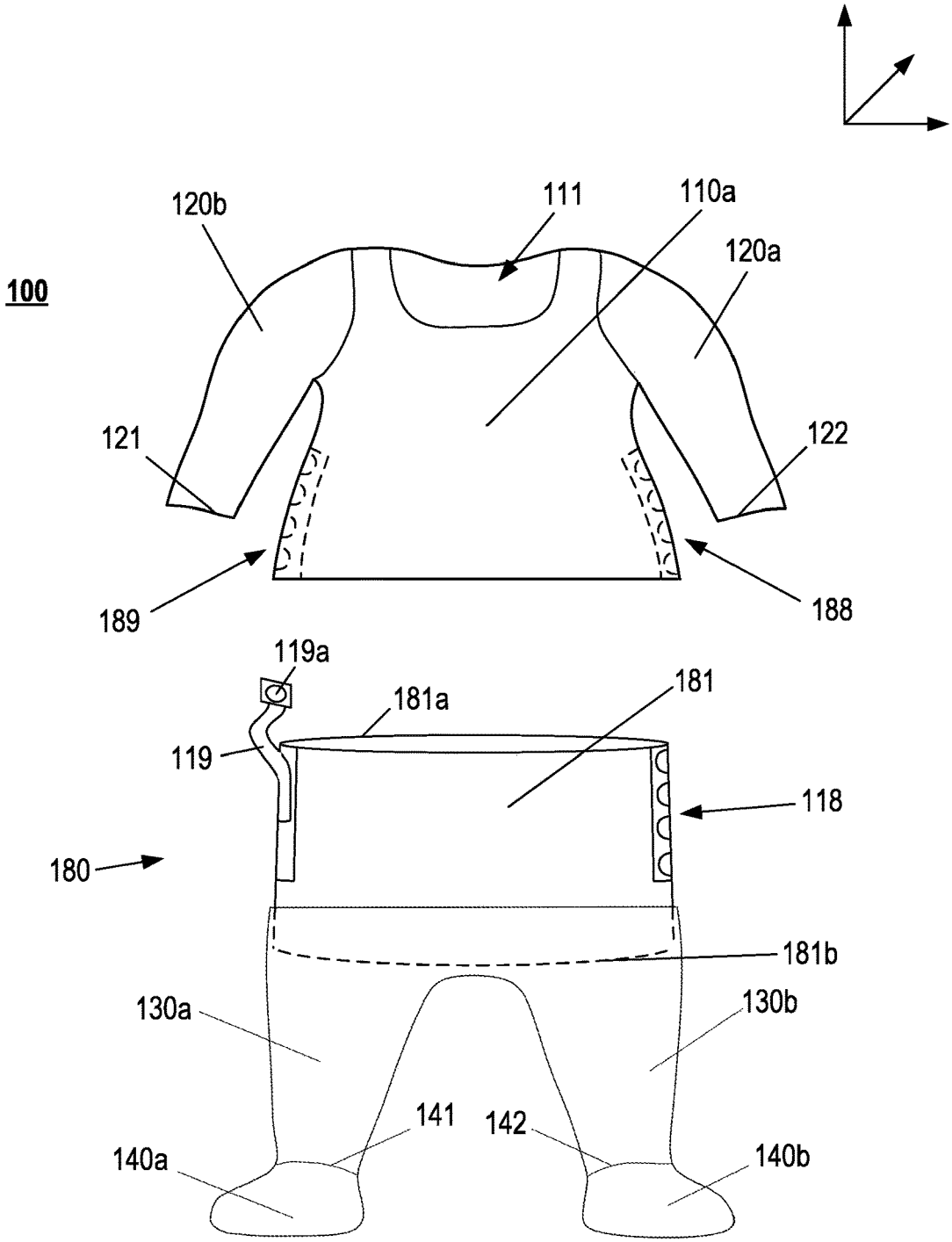
FIG. 6 illustrates an exploded view of an exemplary garment according to an embodiment described herein.

Referring to FIG. 6, an exploded perspective view of an adjustable garment 100 according to an exemplary embodiment is schematically depicted. In particular, FIG. 6 illustrates an exploded view of an exemplary adjustable garment 100 that includes an adjustable element comprising an expandable body portion 180, according to various embodiments. In various embodiments, an exemplary adjustable garment 100 may be configured such that one or both of an upper expandable body panel end 181*a* and a lower expandable body panel end 181*b* may be fixedly secured to a portion of the adjustable garment 100 (e.g., at respective portions along an interior surface of body portion 110). As illustrated in the exemplary embodiment provided in FIG. 6, at least a portion of the lower expandable body panel end 181*b* (e.g., around an entirety of the perimeter thereof) may be fixedly secured to a corresponding interior perimeter portion along an inner surface of the body portion 110. For example, the lower expandable body panel end 181*b* may be fixedly secured along the inner surface of the body portion 110 at least substantially adjacent a lower end of the body portion 110 (e.g., as measured in a length direction). Alternatively, or additionally, in various embodiments, one of the upper expandable body panel end 181*a* and the lower expandable body panel end 181*b* may be fixedly secured to a portion of the body portion 110 adjacent thereto, and the other may be removably coupled to an adjacent surface of the body portion 110. For example, one of the upper expandable body panel end 181*a* and the lower expandable body panel end 181*b* may be removably coupled to an adjacent surface of the body portion 110 by one or more removable and/or semi-permanent fastening means defined at least in part by a plurality of fastening elements.

In the exemplary adjustable garment embodiment illustrated in in FIG. 6, the lower expandable body panel end 181*b* may be fixedly secured along the inner surface of the body portion 110 at least substantially adjacent a lower end of the body portion 110. Further, as illustrated, the upper expandable body panel end 181*a* may be removably coupled to the body portion 110 (e.g., an upper portion of the body portion 110) via a detachable configuration defined between at least a portion of a plurality of incremental adjustment fastener elements 118 disposed about an expandable body panel 181 and one or more corresponding fastener elements 188 disposed about the body portion 110. In such an exemplary circumstance, at least a portion of the plurality of incremental adjustment fastener elements 118 of the expandable body portion 180 may be selectably coupled to the corresponding fastener elements 188 of the body portion 110 so as to at least temporarily secure the portion of the expandable body portion 180 adjacent the plurality of incremental adjustment fastener elements 118 relative to the portion of the body portion 110 coupled thereto. In various embodiments, the extension length exhibited by the expandable body portion 180 may be selectably adjustable based at least in part on which of the incremental adjustment fastener elements 118 is removably coupled to one of the corresponding fastener elements 188 of the body portion 110, and/or the relative positioning of the corresponding fastener elements 188 to which the coupled incremental adjustment fastener elements 118 are removably secured, as measured in the length direction. As non-limiting exemplary configurations provided for illustrative purposes, in the exemplary embodiment illustrated in FIG. 6 wherein the plurality of incremental adjustment fastener elements 118 is arranged in an at least substantially stacked configuration that extends in the length direction such that each fastener elements corresponds to a distinct position relative along the length of the garment, the extension length may be maximized when an uppermost incremental adjustment fastener element (e.g., fastener element 118*a*) is removably coupled to a lowermost fastener element of the corresponding plurality disposed about the body portion 110. In various embodiments, the magnitude of the additional garment length provided to the adjustable garment 100 by way of the one or more adjustable elements (e.g., an expandable body portion 180) may be selectably adjusted based at least in part on the position—measured in the length direction— of the plurality of incremental adjustment fastener elements 118 relative to the corresponding fastener elements 188 selectably coupled thereto In various embodiments, as illustrated in FIG. 6, the one or more adjustable elements of the adjustable garment 100 may comprise an elastic band 119 that may be at removably and/or fixedly secured between one or more of a body portion 110, a leg portion 130*a*, 130*b*, an arm portion 120*a*, 120*b*, and/or an adjustable element, such as, for example, an expandable body portion 180, or any combination thereof. As described herein, the elastic band 119 may be selectably coupled to one or more portions of the adjustable garment (e.g., via a fastener element) such that the elastic band 119 extends in a length direction so as to facilitate an adjustable (i.e. a stretchable) configuration between the one or more portions of the adjustable garment 100 coupled thereto. As illustrated, in various embodiments, an exemplary adjustable garment 100 may comprise an elastic band 119 that is fixedly secured at a first end and further comprises a fastener element 119*a* disposed at a second unconstrained end of the elastic band 119, which may be configured to facilitate a selective coupling of the second unconstrained end of the elastic band 119 to one or more corresponding fastener elements 189.

For example, in the exemplary configuration illustrated in FIG. 6, wherein the elastic band 119 is fixedly secured to an expandable body panel 181 at a fixed first end and wherein the fastener element 119*a* disposed about the second unconstrained end of the band 119 may be selectably coupled to one or more corresponding fastener elements 189 of the body portion 110, the extension length exhibited by the expandable body portion 180 may be selectably adjustable based at least in part on the relative positioning of the corresponding fastener element 189 to which the fastener element 119*a* is selectively coupled, as measured in the length direction. For example, the selective and/or removable coupling of the elastic band 119 to the body portion 110 (e.g., via a fixed body portion fastener element 189 coupled thereto) may enable the expandable body portion 180 to transition between an unexpanded configuration and an expanded configuration caused by one or more pulling forces acting on the expandable body portion 180 (e.g., via the elastic band 119) and resulting in an expansion (e.g., a stretching, a relative displacement, and/or the like) of the expandable body panel 181 in a length direction relative to at least part of the body portion 110. As a non-limiting exemplary configuration provided for illustrative purposes, in the exemplary embodiment illustrated in FIG. 6 wherein the plurality of fastener elements 189 of the body portion 110 is arranged in an at least substantially stacked configuration that extends in the length direction (e.g., such that each fastener elements corresponds to a distinct position relative along the length of the garment), the extension length defined in part by the elastic band 119 may be maximized when the fastener element 119*a* is removably coupled to a lowermost fastener element of the plurality 189 disposed about the body portion 110. In various embodiments, the magnitude of the additional garment length provided to the adjustable garment 100 by way of the one or more adjustable elements (e.g., an elastic band 119 extending from an expandable body portion 180 in a length direction) may be selectably adjusted based at least in part on the relative positioning in the length direction of the fastening element 189 to which the fastening element 119*a* of the elastic band 119 is coupled.

In various embodiments, the one or more adjustable elements of the adjustable garment 100 may comprise a plurality of elastic bands 119 configured to adjustably extend in a length direction between one or more portions of the adjustable garment so as to at least partially define an extension length, as described herein. For example, in various embodiments, an exemplary elastic band 119, as described herein, may extend between an arm portion 120*a*, 120*b* and a leg portion 130*a*, 130*b*.

Figure 7:
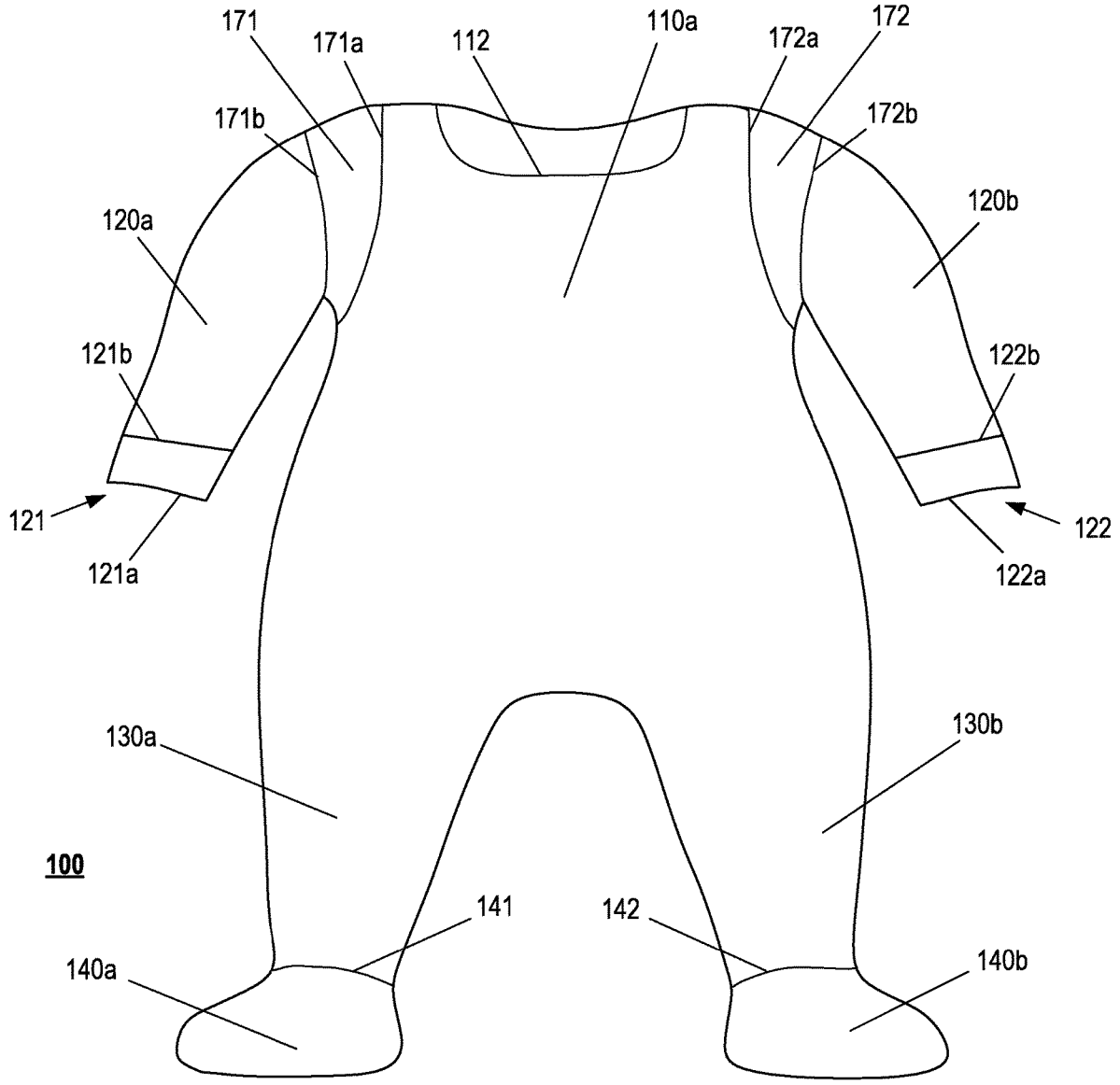
FIG. 7 illustrates a front view of an exemplary garment according to an embodiment described herein.
Figure 8:
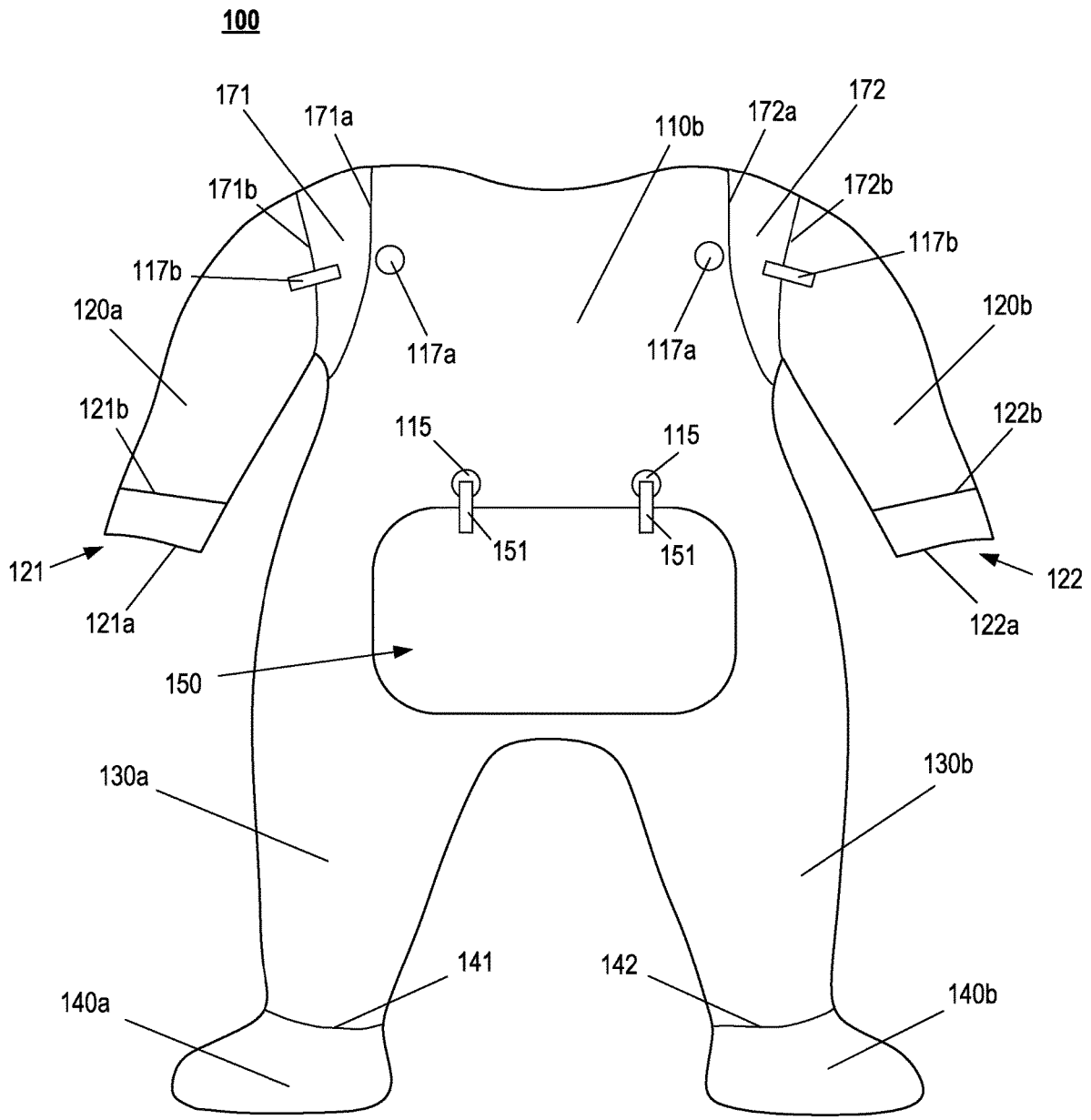
FIG. 8 illustrates a back view of an exemplary garment according to an embodiment described herein.

Referring to FIGS. 7-8, front and rear views of an exemplary adjustable garment 100 according to an embodiment is schematically depicted. In particular, FIGS. 7-8 illustrate an exemplary embodiment wherein an adjustable garment 100 comprises a plurality of adjustable elements (e.g., expandable portions) disposed within a particular localized portion of the garment 100. As non-limiting examples, an exemplary adjustable garment 100 may comprise a plurality of adjustable elements positioned at least partially within a single arm portion (e.g., a first arm portion 120*a*) and/or a plurality of adjustable elements positioned at least partially within a single leg portion (e.g., a first leg portion 130*a*). In various embodiments, a plurality of adjustable elements, such as, for example, a plurality of expandable portions, as described herein, may be disposed within an arm portion of the adjustable garment 100, such that the length of the arm portion may be defined at least in part by the plurality of expandable portions positioned therein.

For example, as illustrated in FIGS. 7-8, a first arm portion 120*a* may comprise a plurality of adjustable elements (e.g., expandable portions), including a first expandable arm portion 121 and a first expandable shoulder portion 171. In various embodiments, as described herein, a first expandable arm portion 121 may comprise a length of material within the first arm portion 120*a* extending between a first end 121*b* and a second end 121*a* in a length direction (e.g., at least substantially in the z-direction), and may be arranged so as to define a lower end of the first arm portion 120*a*. Further, in various embodiments, the plurality of adjustable element disposed defined within the first arm portion 120*a* may further comprise a first expandable shoulder portion 171 comprising a length of material extending along a length of the first arm portion 120*a* between a first end 171*a* and a second end 171*b*, each end being fixedly secured to a respective adjacent portion of the adjustable garment 100. For example, the first end 171*a* may define an upper end of the first expandable shoulder portion 171 and may be fixedly secured at least substantially adjacent a portion of an upper end of the body portion 110. Further, the second end 171*b* may define a lower end of the first expandable shoulder portion 171 and may be fixedly secured at least substantially adjacent an upper portion of the first arm portion 120*a*.

Although described herein with respect to an exemplary configuration wherein the first arm portion 120*a* comprises a plurality of adjustable elements including a first expandable arm portion 121 and a first expandable shoulder portion 171, it should be understood that a second arm portion 120*b* of the adjustable garment 120 may similarly comprise a plurality of adjustable elements. In such an exemplary circumstance, for example, the second arm portion 120*b* may comprise a second expandable arm portion 122 and a second expandable shoulder portion 172, and may be defined at least in part by a configuration that mirrors the exemplary configuration of the first arm portion 120*a*, as described herein. Further, it should also be understood that one or both of the leg portions 130*a*, 130*b* of the adjustable garment 100 may similarly include a plurality of adjustable elements. In such an exemplary circumstance, for example, a first leg portion 130*a* may comprise a first upper expandable leg portion disposed at least substantially adjacent a body portion 110, and a first lower expandable leg portion disposed at least substantially adjacent a first lower leg portion end 141. In various embodiments, a second leg portion 130*b* may be defined at least in part by a plurality of adjustable elements having a configuration that at least substantially mirrors the exemplary configuration of the first leg portion 130*a*, as described above.

Figure 9:
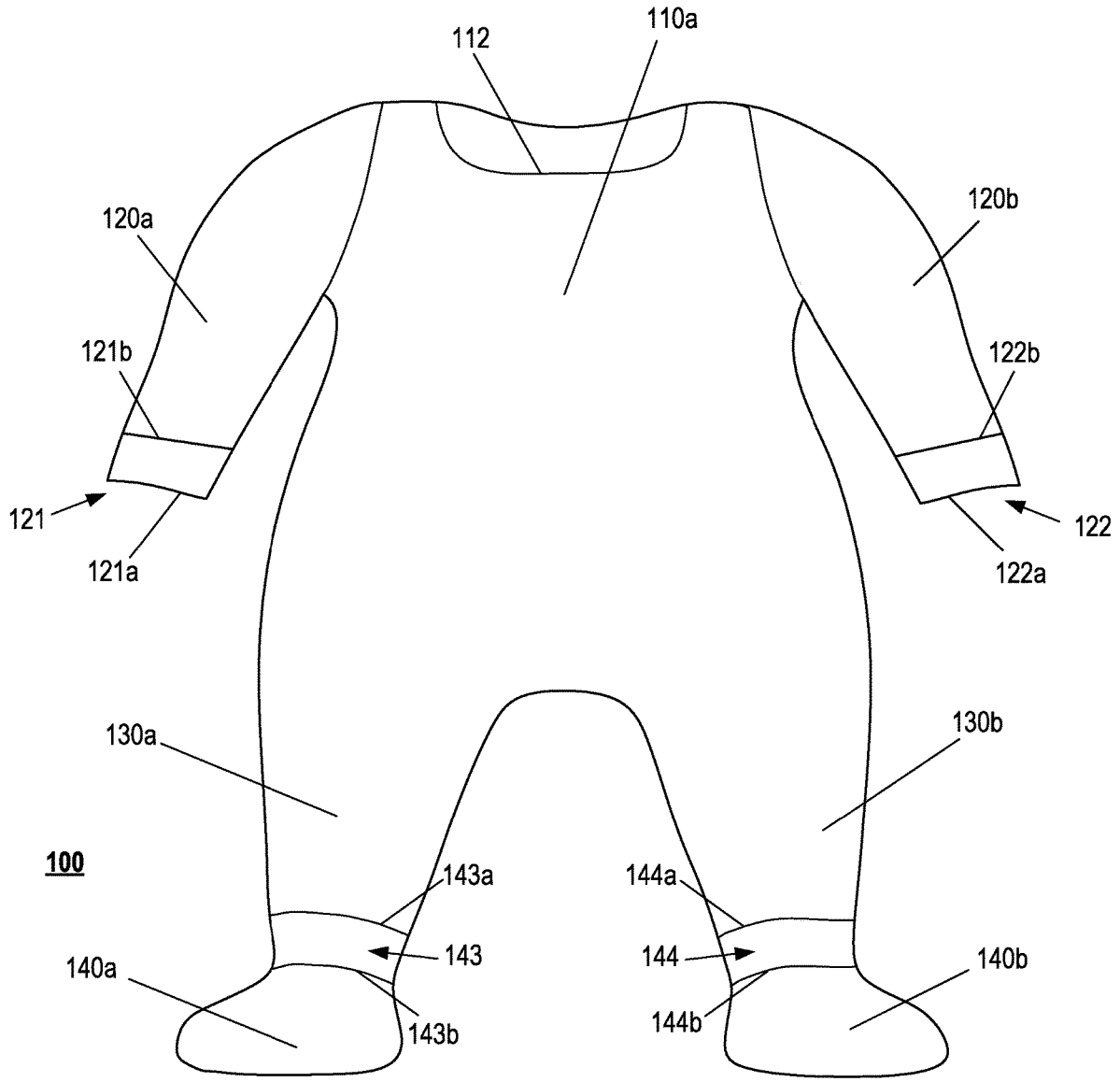
FIG. 9 illustrates a front view of an exemplary garment according to an embodiment described herein.
Figure 10:
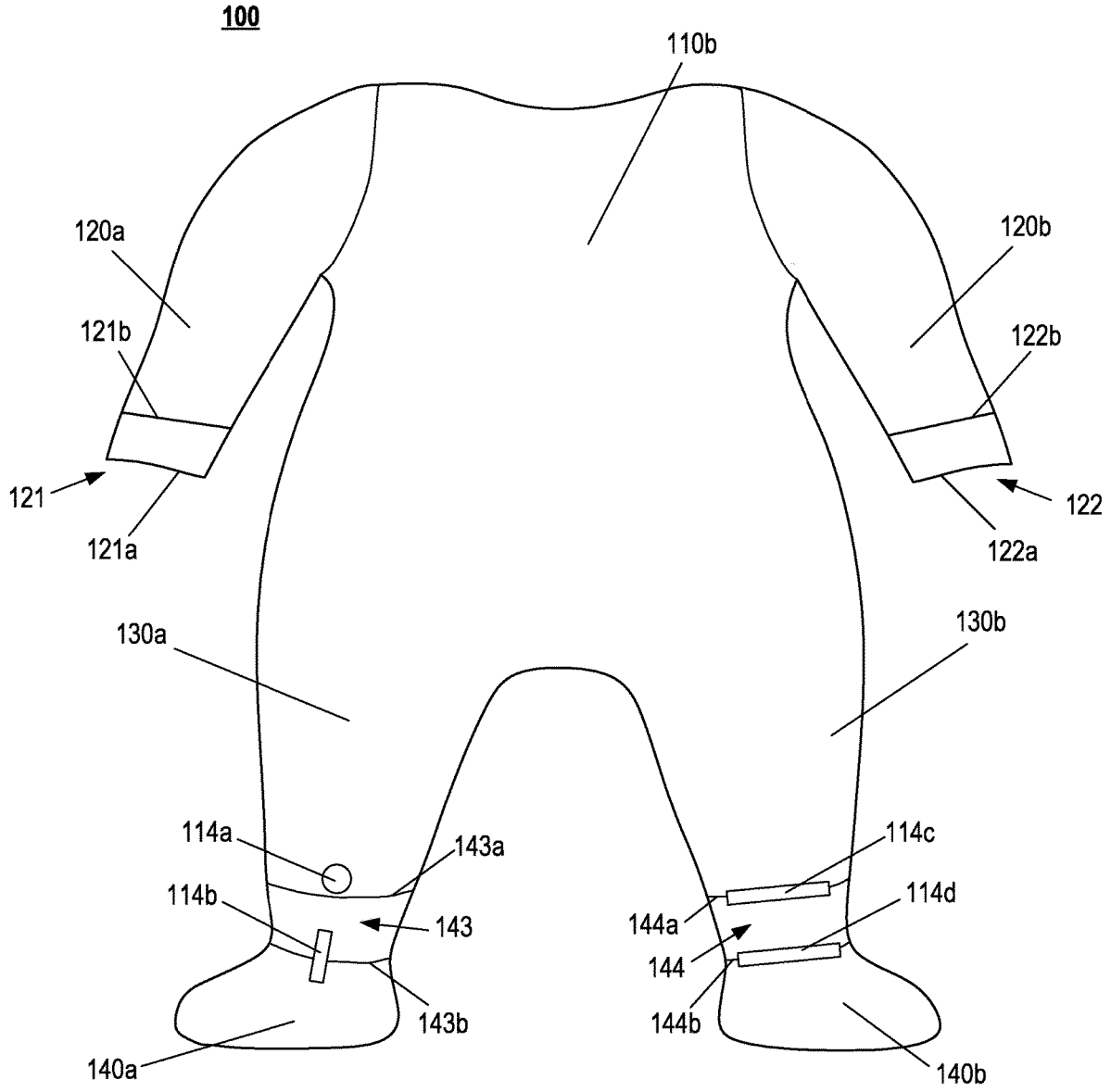
FIG. 10 illustrates a back view of an exemplary garment according to an embodiment described herein.

Referring to FIGS. 9-10, front and rear views of an exemplary adjustable garment 100 according to an embodiment is schematically depicted. In particular, FIGS. 9-10 illustrate an exemplary embodiment wherein an adjustable garment 100 comprises a plurality of adjustable elements. As illustrated in FIG. 10, in various embodiments, wherein the adjustable garment 100 comprises a plurality of adjustable elements (e.g., expandable portions), one or more of the plurality of adjustable elements may comprise a configuration that is at least substantially different from one or more of the other adjustable elements of the plurality. As a non-limiting example provided for illustrative purposes, in various embodiments a plurality of adjustable elements may comprise a first expandable leg portion 143 disposed within a first leg portion 130*a*, and a second expandable leg portion 144 disposed within a second leg portion 130*b*. In various embodiments, the first expandable leg portion 143 may comprise a first configuration that is at least substantially different from a second configuration defined by the second expandable leg portion 144. For example, in various embodiments, an at least substantially different configuration may be defined at least in part by a difference in material, fastener element configuration, positioning, and/or the like, or any combination thereof. As illustrated, the first expandable leg portion 143 comprises a first pair of corresponding fastener elements 114*a*, 114*b*, and the second expandable leg portion 144 comprises a second pair of corresponding fastener elements 114*c*, 114*d* defining an at least substantially different configuration than that of the first pair of corresponding fastener elements 114*a*, 114*b* included in the first expandable leg portion 143.

Many modifications and other embodiments will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. An adjustable garment comprising:

a body portion comprising:

one or more leg portions configured to cover at least a portion of a wearer's legs;

a pair of detachable foot covers configured to cover and extend over the wearer's feet;

one or more adjustable elements configured to facilitate an adjustment of a length of at least a portion of the adjustable garment in one or more length directions;

a rear opening arranged about a back side; and a rear cover panel configured to extend over the rear opening;

wherein the adjustable garment is selectively configurable between an unexpanded configuration and an expanded configuration based at least in part on the one or more adjustable elements; and wherein the rear cover panel is selectively configurable between an open position and a closed position, wherein the open position is defined by a first portion of the rear cover panel being detached from the back side so as to at least partially expose the rear opening, while a second portion of the rear cover panel remains attached to the back side;

wherein at least one of the one or more adjustable elements comprises an expandable portion and a plurality of fastener elements arranged adjacent the expandable portion, the plurality of fastener elements comprising a first fastener element, a second fastener element, and a convertible fastener element configured for selective coupling between the first fastener element and the second fastener element to selectively adjust an expandable portion length of the expandable portion, wherein the length of the at least a portion of the adjustable garment is defined at least in part by the expandable portion length of the expandable portion, wherein the at least one or more adjustable elements is configured such that coupling the convertible fastener element to the second fastener element causes the expandable portion length to decrease such that the adjustable garment is defined the unexpanded configuration, wherein the at least one or more adjustable elements is configured such that coupling the convertible fastener element to the first fastener element in order to configure the adjustable garment in the expanded configuration by enabling an increase in the expandable portion length, wherein the first fastener element and the second fastener element are fixedly attached to distinct portions of the adjustable garment; and wherein the first fastener element is fixedly attached to the rear cover panel and the second fastener element is fixedly attached to the one or more leg portions.

2. The adjustable garment of claim 1, wherein the rear cover panel comprises a material that is different from the body portion.

3. The adjustable garment of claim 2, wherein the material of the rear cover panel that is different from the body portion comprises an elastic material.

4. The adjustable garment of claim 1, wherein the one or more adjustable elements comprises an elastic garment portion formed from an elastic material.

5. The adjustable garment of claim 4, wherein the elastic garment portion is configured to facilitate a transition of the adjustable garment between the unexpanded configuration and the expanded configuration based on one or more pulling forces acting on the elastic garment portion caused by the wearer's body.

6. The adjustable garment of claim 1, wherein at least one of the one or more of the adjustable elements comprises an expandable portion including one or more fastener elements and a material portion defined at least in part by an expansion length, wherein the adjustable garment is configured such that the length of the at least a portion of the adjustable garment is increased by an additional length corresponding to the expansion length of the material portion when the expandable portion is configured in the expanded configuration.

7. The adjustable garment of claim 1, wherein the one or more adjustable elements is located on the one or more leg portions.

8. The adjustable garment of claim 1, further comprising a pair of arm portions coupled to and extending outward from the body portion.

9. The adjustable garment of claim 8, wherein each of the pair of arm portions comprises a respective adjustable element of the one or more adjustable elements, the respective adjustable element located along each of the pair of arm portions, respectively.

* * * * *